US006910905B2

(12) United States Patent
Tanaka et al.

(10) Patent No.: US 6,910,905 B2
(45) Date of Patent: Jun. 28, 2005

(54) WATERPROOF CONNECTOR

(75) Inventors: Nobuyoshi Tanaka, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/370,058

(22) Filed: Feb. 21, 2003

(65) Prior Publication Data

US 2003/0190830 A1 Oct. 9, 2003

(30) Foreign Application Priority Data

Apr. 4, 2002 (JP) ..... 2002-102402

(51) Int. Cl.[7] ..... H01R 13/52
(52) U.S. Cl. ..... 439/271; 439/589
(58) Field of Search ..... 439/271–3, 282, 439/587–9, 589

(56) References Cited

U.S. PATENT DOCUMENTS 2,906,986 A * 9/1959 Schaefer ..... 439/589
6,402,538 B2 * 6/2002 Suzuki ..... 439/271
6,520,788 B2 * 2/2003 Ichida et al. ..... 439/271

FOREIGN PATENT DOCUMENTS

JP 2001-267000 9/2001

* cited by examiner

*Primary Examiner*—Renee Luebke
(74) *Attorney, Agent, or Firm*—Banner & Witcoff, Ltd.

(57) ABSTRACT

On a front end surface of a male housing, a columnar sealing projection is formed for a projected portion of each of the male terminals. A sealing member having through-holes formed thereon is formed integrally with a rear surface of a front plate of a holder. When the holder is mounted on a female housing, a contact surface of the sealing member is pressed against the front end surface of the female housing. When the female housing is connected to the male housing, the inner peripheral surfaces of the through-holes of the sealing member closely contact the peripheral surfaces of the sealing projections with the sealing projections breaking the lips of the sealing member.

13 Claims, 13 Drawing Sheets

FIG. 10A
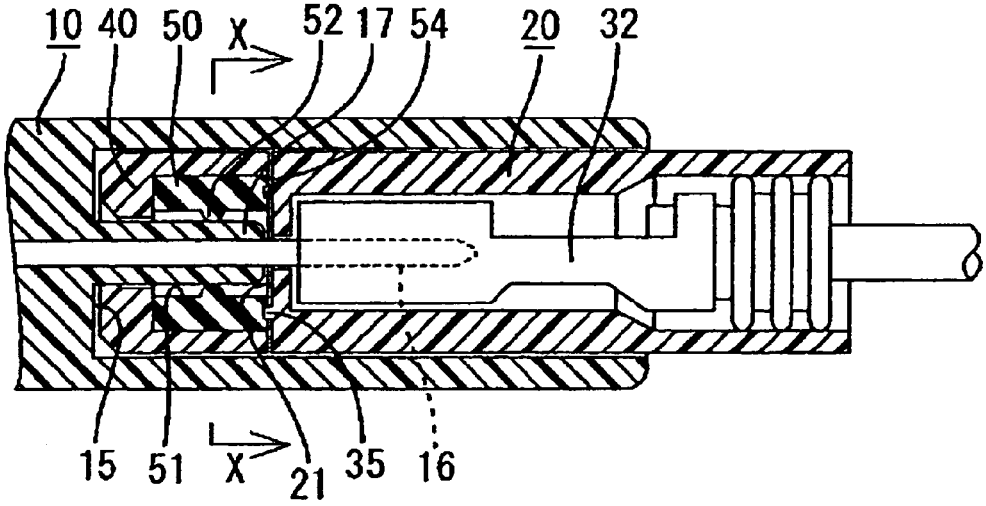
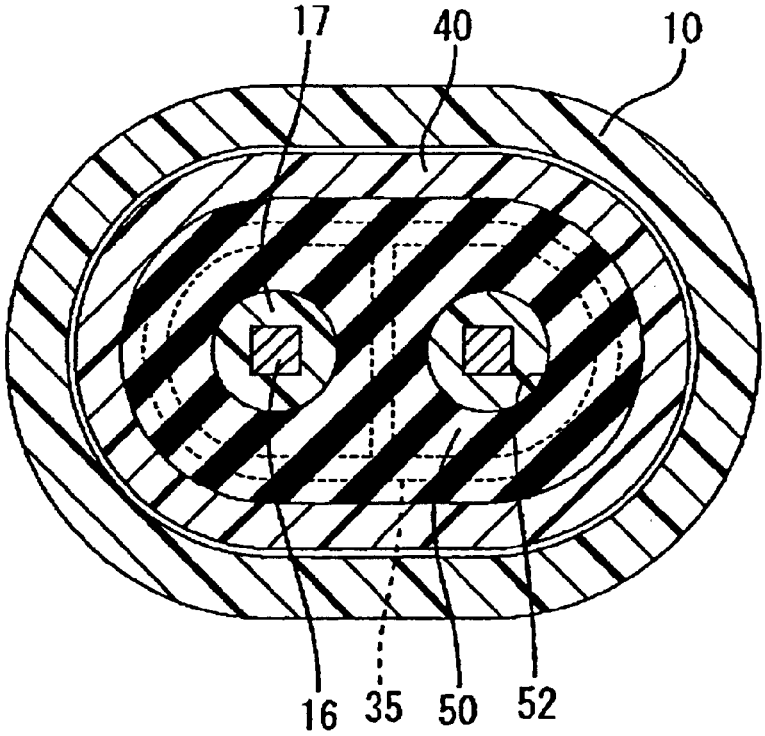
FIG. 10B

WATERPROOF CONNECTOR

BACKGROUND OF THE INVENTION

1. Field of the Invention

The present invention relates to a waterproof connector.

2. Description of the Related Art

A waterproof connector wherein the chamber containing the terminals is sealed is described in Japanese Patent Application No. 2001-267000. This waterproof connector is described below with reference to FIG. 11. The waterproof connector has a female housing 1 provided with a plurality of the cavities 1A for accommodating female terminals 2. The male housing 3 is designed for a printed-circuit board and includes a hood part 3A in which the female housing 1 can be fitted. L-type male terminals 4 project from the front end surface 3B into the hood part 3A. A mounting concavity 5 is formed around the projected portion of the male terminal 4 on the front end surface 3B of the male housing 3. A sealing member 6 is mounted in the mounting concavity 5.

A press-fit groove 7 is formed around the opening 6A on the surface of the sealing member 6. On the front end surface 1B of the female housing 1, an annular rib 8 to be fitted in the press-fit groove 7 stands erect around the front opening of the cavity 1A.

When the female housing 1 is connected to the male housing 3, the rib 8 of the female housing 1 is pressed into the press-fit groove 7 of the sealing member 6. Waterproofing of the chamber in female housing 1 can be accomplished by close contact between the peripheral surface of the rib 8 and that of the press-fit groove 7. Waterproofing of the chamber in the male housing 3 can be accomplished by close contact between the peripheral surface of the mounting concavity 5 and that of the opening 6A of the sealing member 6.

However, in the above-described construction, the sealing member 6 is mounted on the male housing 3. In mounting the sealing member 6 on the male housing 3, it is necessary to insert the sealing member 6 into the hood part 3A into which the male terminals 4 project and fit the sealing member 6 in the mounting concavity 5. Thus, a connector with this conventional construction has a problem in that it takes much time and labor to perform the operation of mounting the sealing member 6 on the male housing 3.

SUMMARY OF THE INVENTION

The present invention has been made in view of the above-described situation. Thus, objects of the present invention are to enable an easy mounting of a sealing member on a female housing and provide a compact connector.

To achieve the objects, there is preferably provided a waterproof connector comprising a female housing having a plurality of cavities accommodating a plurality of female terminals, and a male housing to be connected to the female housing and having a plurality of male terminals. The male terminals project from a front end surface of the male housing to connect to the female terminals. In this construction, a sealing member, having through-holes formed at positions to correspond to the cavities, contacts a front end surface of the female housing. Each of the through-holes is capable of contacting a peripheral surface of a projected portion of a corresponding male terminal at the front end surface of the male housing.

Preferably, the sealing member is held on the front end surface of the female housing by a holder mounted on the front end surface.

Preferably, the sealing member is formed integrally with the holder by two-color molding.

According to the present invention, the through-hole of the sealing member is closely fitted over the projected portion of the male terminal c when the female housing is fitted to the male housing. The sealing member is sandwiched between the front end surface of the female housing and that of the male housing. In the male housing, the inner peripheral surface of the through-hole of the sealing member closely contacts the peripheral surface of the sealing projection of the male terminal. In the female housing, the contact surface of the sealing member closely contacts (i.e., face contact) the front end surface of the female housing. In this way, waterproofing of the connector is accomplished.

Since the sealing member is installed on the exposed front end surface of the female housing, it is easy to install the sealing member into the connector.

In the sealing construction of the female housing, the sealing member makes face contact with the front end surface of the female housing. Thus, unlike the conventional case in which the inner peripheral surface of the sealing member contacts the peripheral surface of the terminal, it is unnecessary to provide the sealing member separately for each terminal or provide a space between adjacent terminals to insert a rib therebetween. Accordingly, it is possible to make the interval between the adjacent terminals short and to make the connector compact.

If there is a difference between the interval between the male terminals and that between the female terminals, the sealing member is capable of absorbing the difference. The sealing member slides on the front end surface of the female housing. In the male housing, the sealing member accomplishes uniform sealing by the circumferential close contact between the through-hole thereof and the sealing projection of the male terminal. In the female housing, the sealing member accomplishes uniform sealing by the close face contact between the contact surface thereof and the front end surface of the female housing.

By mounting the holder on the front end surface of the female housing, the sealing member is held on the front end surface with the sealing member in contact with the front end surface.

The sealing member is preferably formed integrally with the holder by two-color molding. In this way, the number of component parts can be reduced and the mounting operation can be performed easily.

BRIEF DESCRIPTION OF THE DRAWINGS

FIG. 10A is a side sectional view of a concept drawing showing a state in which the male housing and the female housing are fitted together.

FIG. 10B is an enlarged sectional view taken along a line 10B—10B of FIG. 10A.

DETAILED DESCRIPTION OF THE PREFERRED EMBODIMENTS

An embodiment of the present invention is described below with reference to FIGS. 1 through 10.

Figure 1:
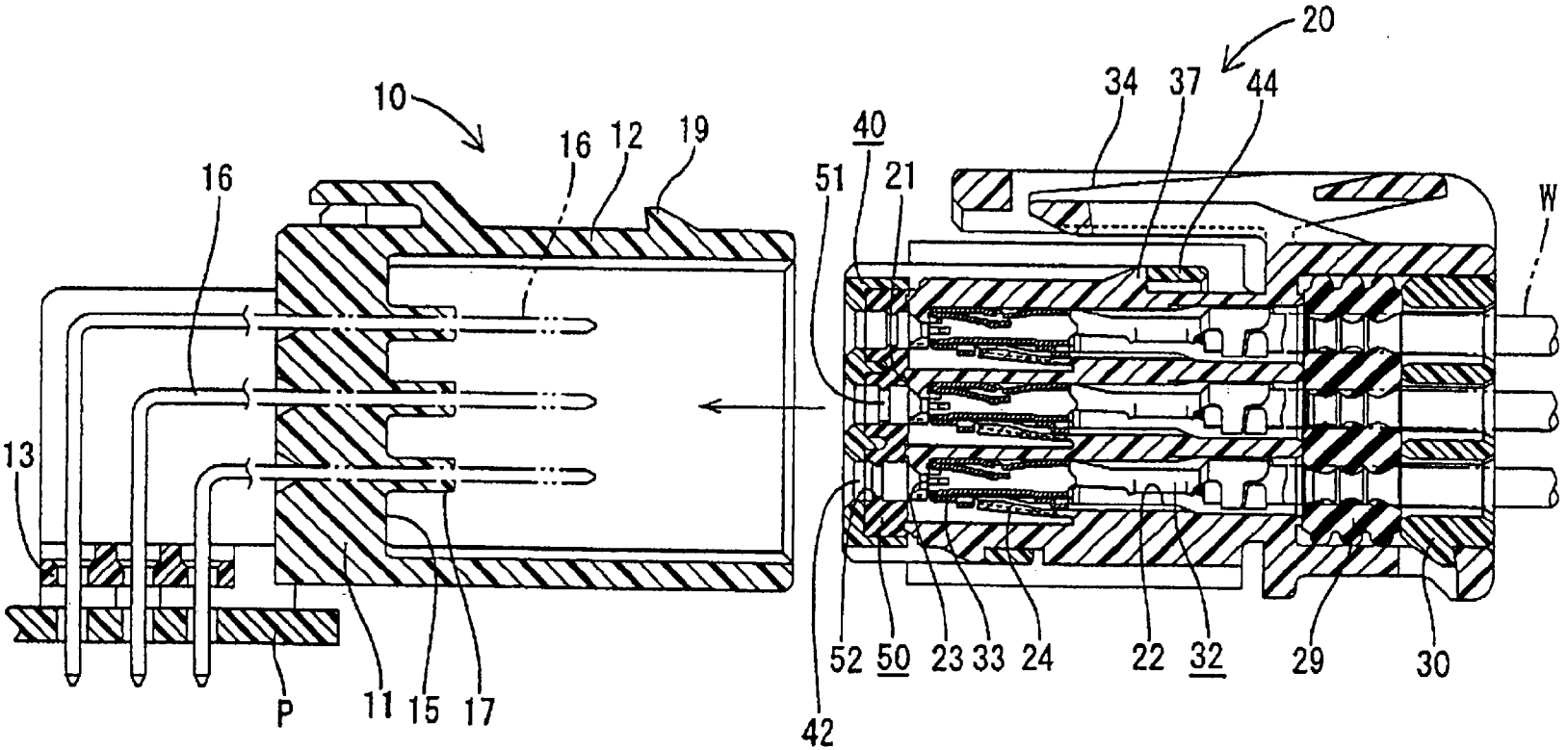
FIG. 1 is a side sectional view showing a state before a male housing and a female housing of a connector are fitted together according to an embodiment of the present invention.

As shown in FIG. 1, the waterproof connector of the illustrated embodiment has a male housing 10, a female housing 20, and a sealing member 50 to be mounted on the female housing 20. In the description below, the sides of the male housing 10 and of the female housing 20 that connect to the opposing housing are each considered as the front or forward side.

The male housing 10 is preferably of a substrate-installed type and made of a synthetic resinous material. A hood part 12 projects from a front surface of a body plate 11. A mounting plate 13 for a printed-circuit board P is formed at a lower portion of a rear surface of the body plate 11. The front surface of the body plate 11 serves as a front end surface 15 of the male housing 10.

Figure 2:
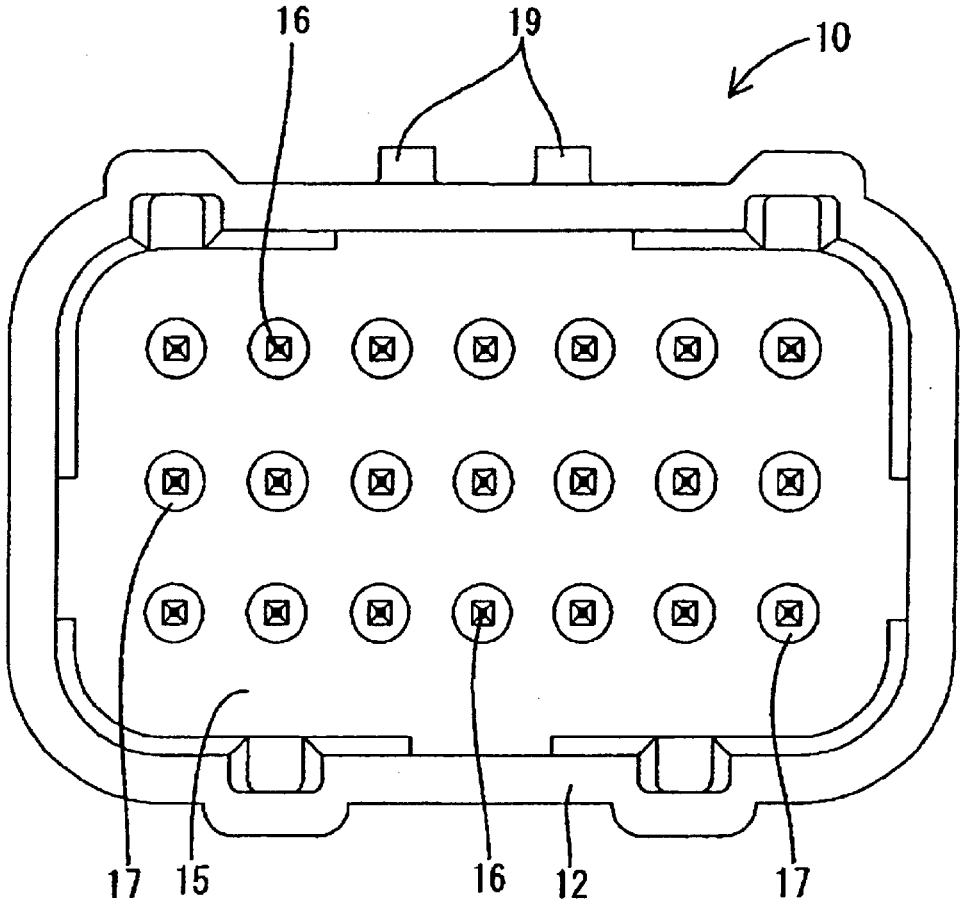
FIG. 2 is a front view showing the male housing.

L-shaped male terminals 16 are mounted inside the male housing 10 by insert molding. As shown in FIG. 2, the male terminals 16 are preferably arranged in seven rows and three stages, with one end of each of them projecting into the hood part 12 from the front end surface 15. A columnar sealing projection 17 extends from the front end surface about a projected portion of each of the male terminals 16.

The other end of each of the male terminals 16 projects rearward from the rear surface of the body plate 11 and is bent downward. The mounting plate 13 is mounted on the printed-circuit board P. The other end of each of the male terminals 16 is soldered to a conductive path of the printed-circuit board P. A locking projection or member 19 is formed on an upper surface of the hood part 12 at a position near its front end.

The female housing 20 is also preferably made of a synthetic resinous material. The front side of the female housing 20 is block-shaped so that the front side thereof can be fit into the hood part 12 of the male housing 10. The front surface of the female housing 20 serves as a front end surface 21.

Figure 3:
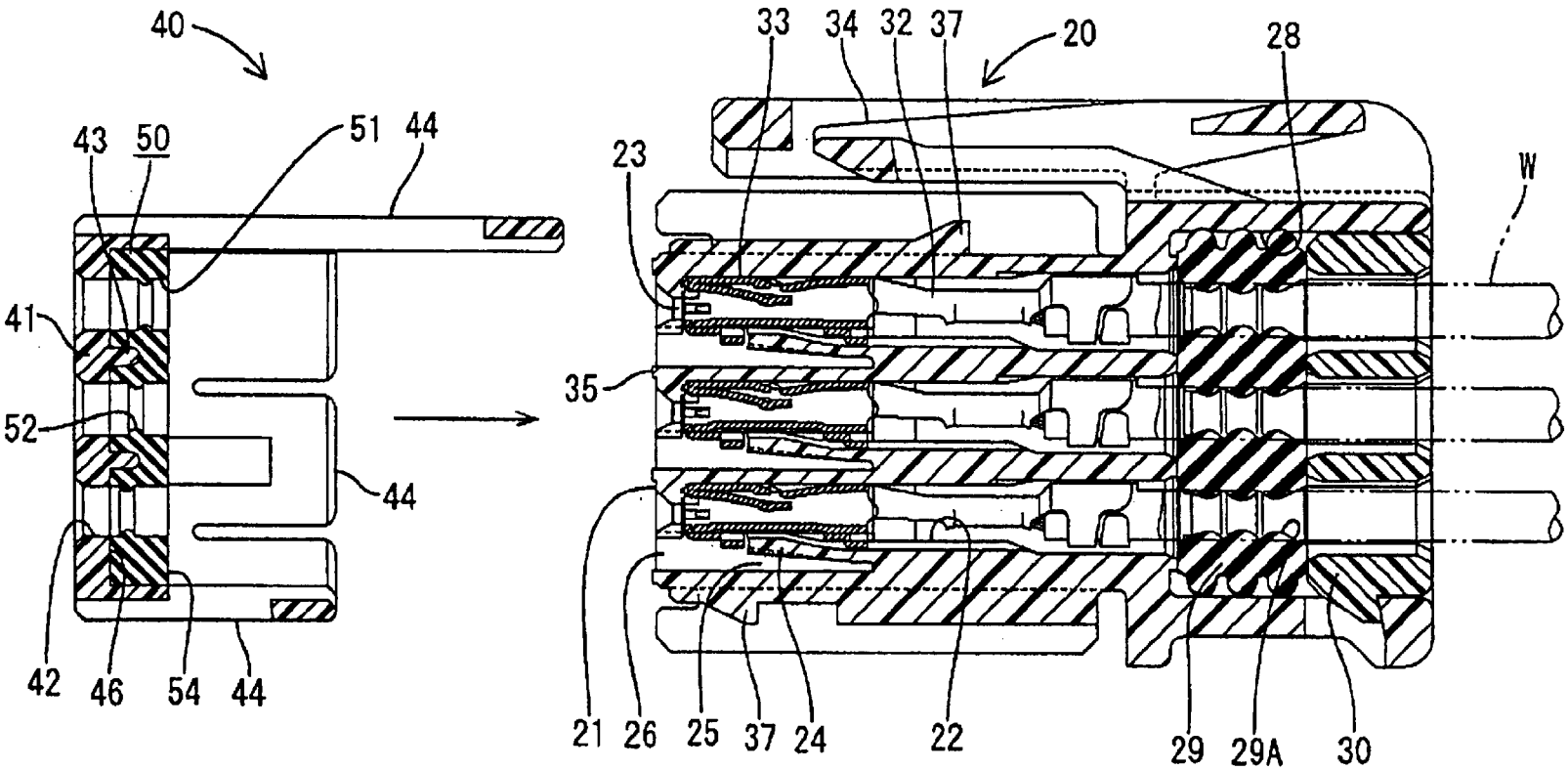
FIG. 3 is a side sectional view showing a state before a holder is mounted on the female housing.
Figure 4:
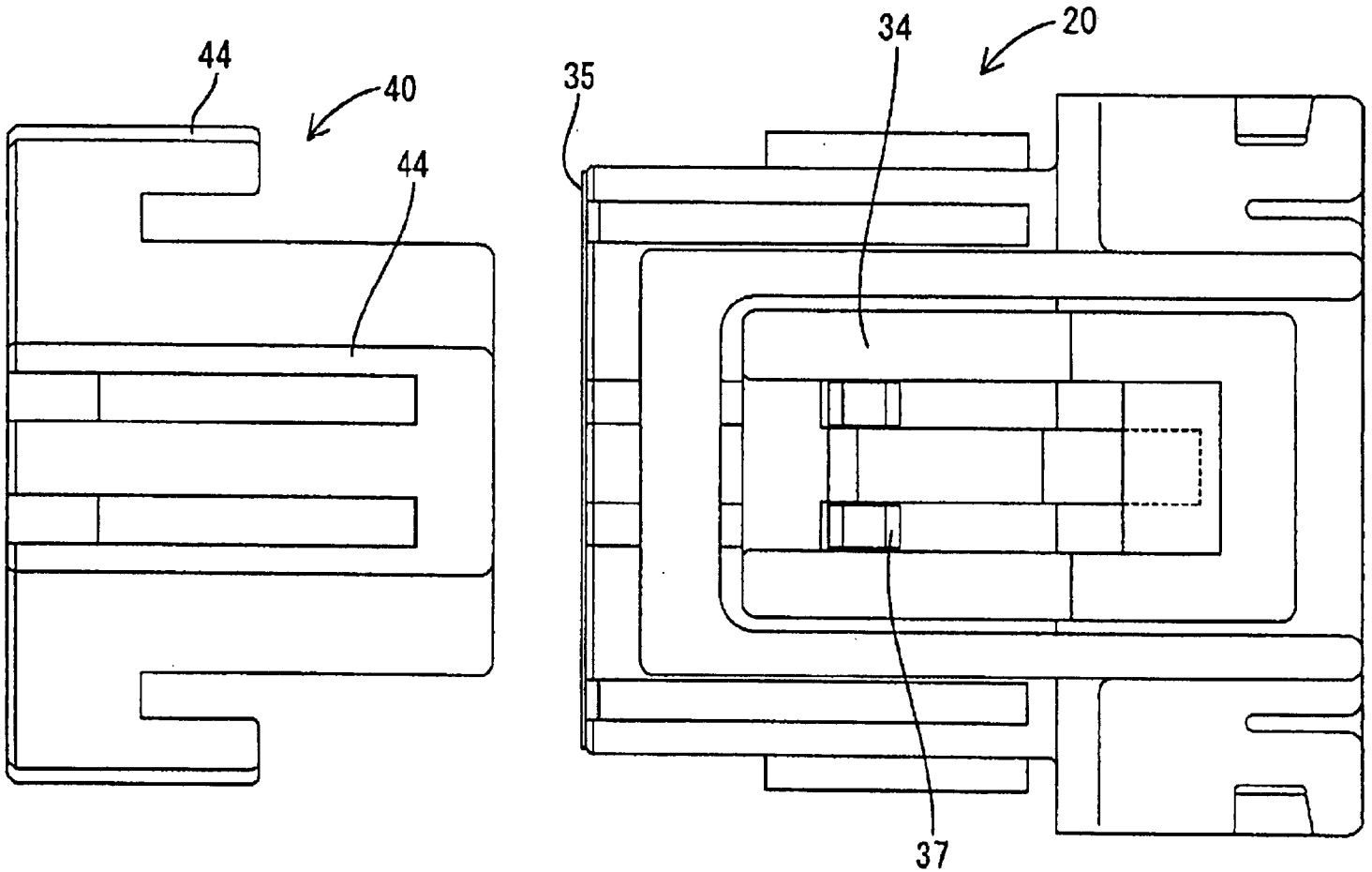
FIG. 4 is a plan view showing the state before the holder is mounted on the female housing.
Figure 5:
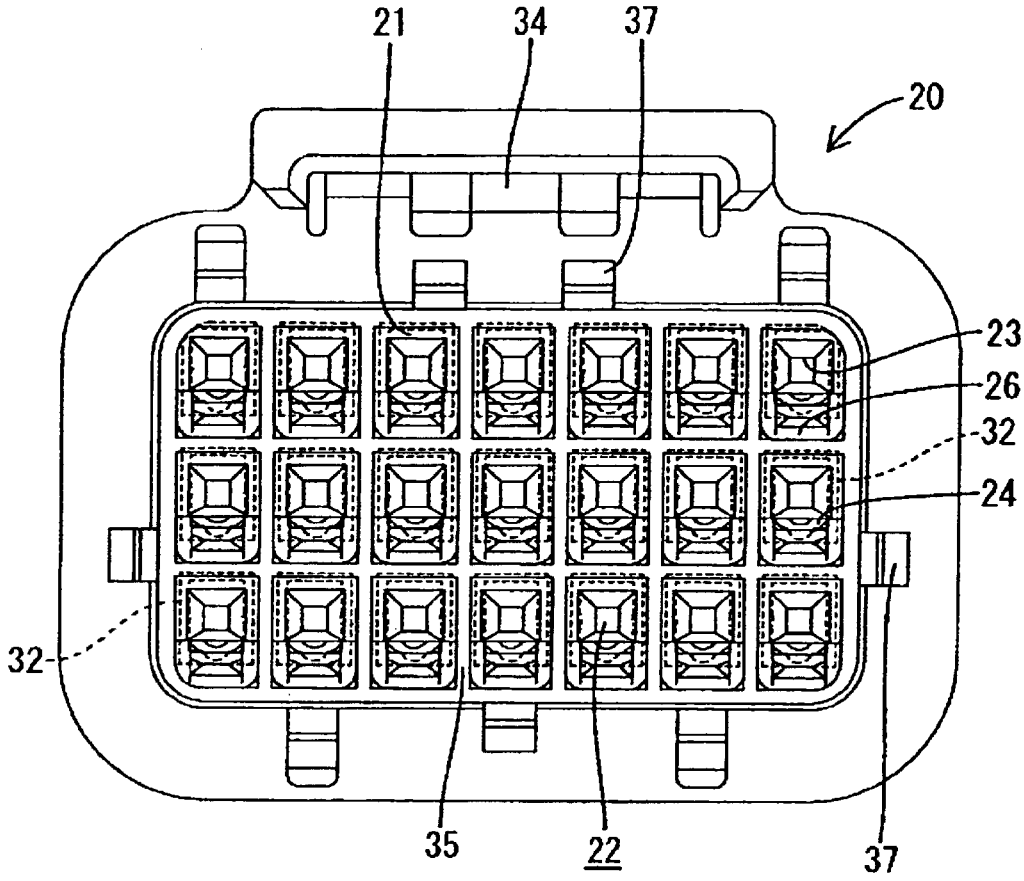
FIG. 5 is a front view showing a female housing.

As also shown in FIG. 5, cavities 22 are formed inside the female housing 20 in a front-to-back direction thereof at positions corresponding to those of the male terminals 16 of the male housing 10. As also shown in FIG. 3, a terminal insertion opening 23 is formed on the front end of each cavity 22 to receive one of the male terminals 16 therethrough for insertion into the female housing. A lance 24 is provided on the bottom wall of each cavity 22. The lances can elastically deform in a space 25 disposed below the lances 24. The front side of space 25 is open to form an insertion opening 26 into which an unlocking jig can be inserted.

As shown in FIG. 3, a mounting opening 28 open at the entrance of each cavity 22 is formed at the rear side of the female housing 20. A one-piece rubber plug 29 is fit into the mounting opening 28 and held by a rubber plug-holding member 30.

Female terminals 32 fixed to terminals of electric wires W penetrate through the one-piece rubber plug 29 and are inserted into the cavities 22 respectively from the rear thereof. As shown in FIG. 3, when the female terminals 32 are inserted into the cavities 22 at a normal position, the lances 24 elastically bead and lock them into place to prevent removal of the female terminals 32. Through-holes 29A of the one-piece rubber plug 29 contact and closely hold the peripheral surfaces of each of the electric wires W. Accordingly, the entrance of each cavity 22 is closed.

A seesaw-shaped locking arm 34 that can be locked to the locking projection 19 of the male housing 10 is provided on the upper surface of the female housing 20.

The chamber sealing member 50 is mounted on the front end surface 21 of the female housing 20.

As shown in FIGS. 3 and 5, low ribs 35 are formed on the front end surface 21 of the female housing 20, in the shape of a lattice in such a way that the ribs 35 surround the terminal insertion openings 23 and the jig insertion openings 26 of the cavities 22 respectively.

As shown in FIG. 1, a holder 40 is mounted on the front end surface 21 of the female housing 20. Similarly to the female housing 20, the holder 40 is preferably made of a hard resin such as PBT (polybutylene terephthalate). The holder 40 is cap-shaped to cover the front end portion of the female housing 20.

Figure 6:
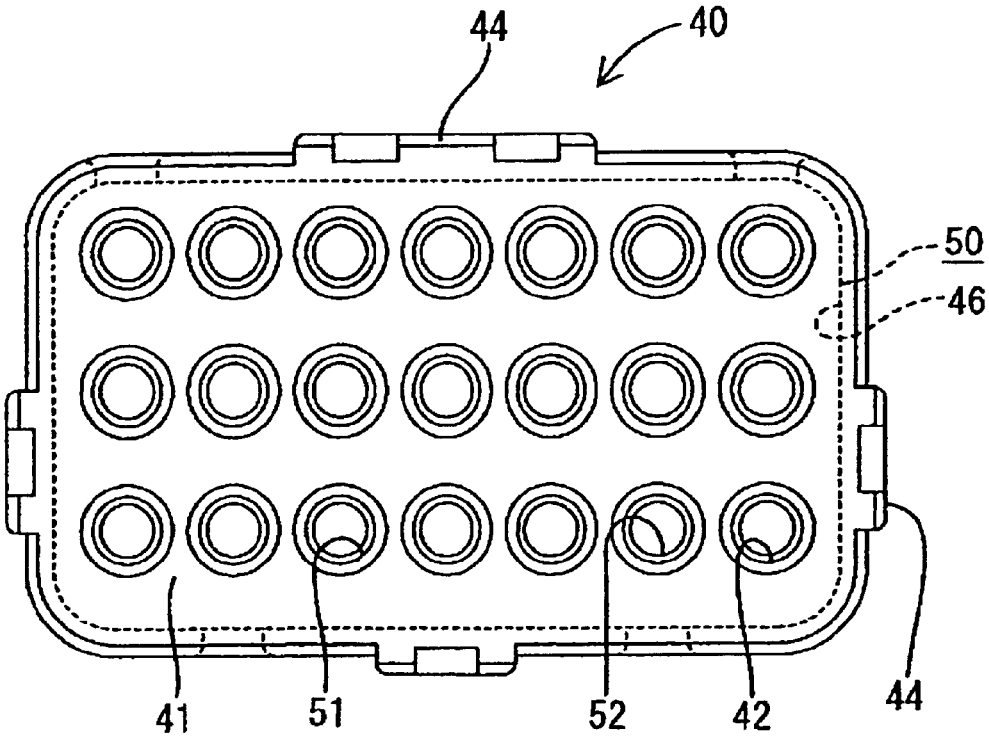
FIG. 6 is a front view showing a holder.
Figure 7:
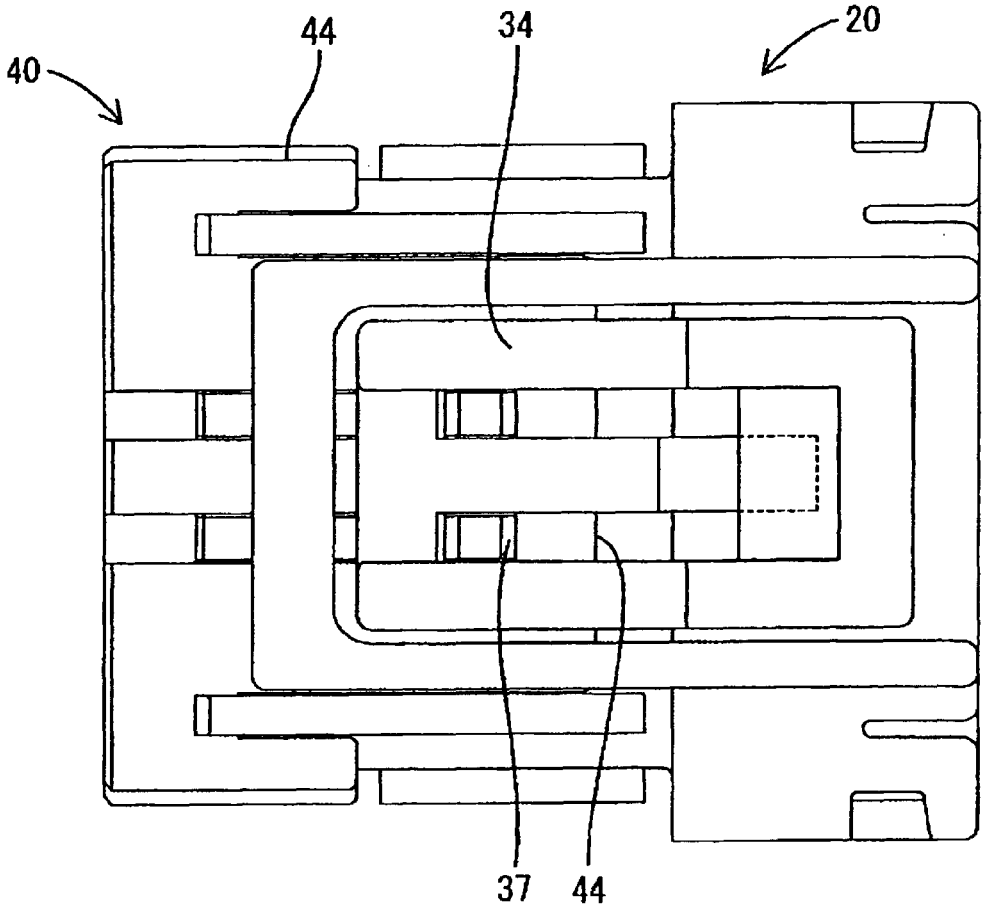
FIG. 7 is a plan view showing a state in which the male housing and the female housing have been fitted together.

As shown in FIG. 6, circular window holes 42 are formed on a front plate 41 of the holder 40, at positions corresponding to those of the cavities 22. The sealing projections 17 projecting forward from the front end surface 15 of the male housing 10 can be inserted into the window holes 42 respectively. The edge of each window hole 42 at its front surface side is tapered to guide the sealing projections 17 as they are inserted into their respective window holes 42.

As shown in FIGS. 3 and 6, an elastically deformable, rearwardly extending cantilevered locking piece 44 is formed on each of the upper, lower, right, and left surfaces of the holder 40. The locking piece 44 formed on the upper surface of the holder 40 is longer than the other three locking pieces 44 in the rearward direction. Complementing locking structures or projections 37 for elastically locking the locking pieces 44 thereto are formed on each of the upper, lower, right, and left surfaces of the female housing 20.

As shown in FIGS. 3 and 6, a mounting concavity 46 is formed almost entirely across a rear surface of the front plate 41 of the holder 40. A thick plate-shaped sealing member 50 is mounted inside the mounting concavity 46. The sealing member 50 is preferably made of a hard resin (rubber) such as silicone rubber and formed integrally with the holder 40 by two-color molding. A rib 43 erect on the rear surface of the front plate 41 projects into the sealing member 50 to form a strong connection between the front plate 41 and the sealing member 50.

Through-holes 51 are formed on the sealing member 50 at positions corresponding to those of the window holes 42 of the holder 40. One lip 52 is formed on the inner peripheral surface of each through-hole 51. The inner diameter of the lip 52 is a little smaller than the outside dimension of the sealing projection 17 of the front end surface 15 of the male housing 10.

As shown in FIG. 3, the lip 52 at an upper stage is shifted rearward from the lip 52 at a lower stage.

The operation of the embodiment will be described below.

As shown in FIG. 3, after the female terminals 32 are inserted into all the cavities 22 and locked by the lances 24, the holder 40 is put on the front end portion of the female housing 20 in the direction of arrow B. The holder 40 is pressed rearward, with the locking pieces 44 being elastically deformed outward by the respective locking projections 37. When the holder 40 is pressed to a position where a contact surface 54 of the sealing member 50 is pressed against the front end surface 21 of the female housing 20, as shown in FIG. 1, the locking pieces 44 elastically return to their original state so as to be locked to the corresponding locking projections 37. In this way, the holder 40 is mounted on the female housing 20. The sealing member 50 is elastically pressed against the front end surface 21 with the ribs 35 cutting into the contact surface 54.

When the holder 40 and the sealing member 50 have been mounted on the female housing 20, the female housing 20 is fit into the hood part 12 of the male housing 10 in the direction of arrow A (FIG. 1). As the coupling operation proceeds, the locking arm 34 elastically deforms and rides over the locking projection 19. The front end of each male terminal 16 penetrates into its corresponding cavity 22 from the terminal insertion opening 23 through the window hole 42 of the holder 40 and the through-hole 51 of the sealing member 50 to connect to a connection portion 33 of the female terminal 32 accommodated in the cavity 22. At the same time, the sealing projection 17 penetrates into the through-hole 51 of the sealing member 50 through the window hole 42 of the holder 40, with the sealing projection 17 breaking the lip 52 formed on the through-hole 51 so as to be placed in sealing contact.

Figure 8:
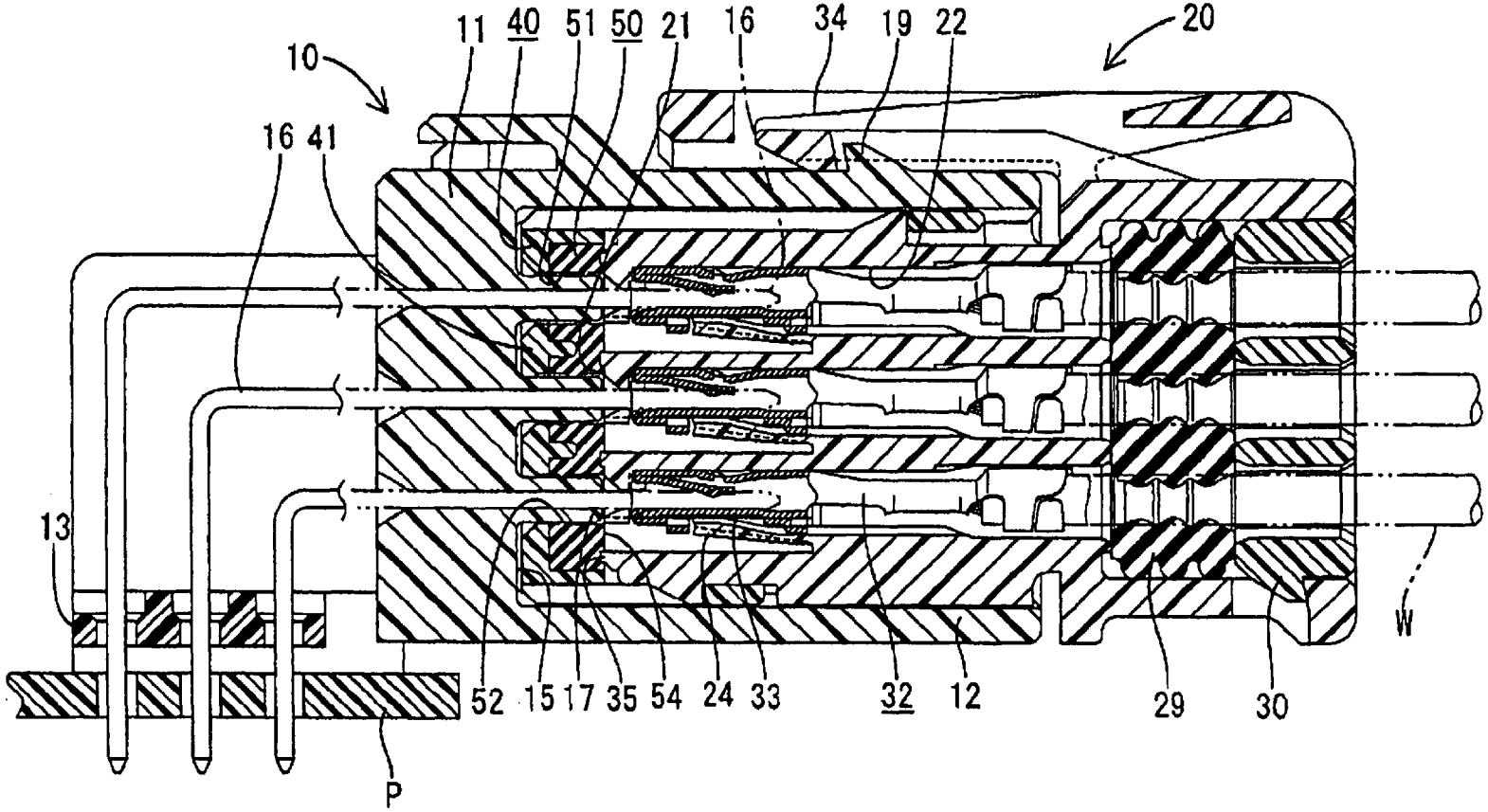
FIG. 8 is a side sectional view showing the state in which the male housing and the female housing have been fitted together.

When the front plate 41 of the holder 40 is pressed to a normal position where the front plate 41 reaches the front end surface 15 of the male housing 10, as shown in FIG. 8, the locking arm 34 elastically returns to its original state and is locked to the locking projection 19. In this way, the male housing 10 and the female housing 20 are locked to each other in a normal connected state. At this time, the male terminals 16 and their corresponding female terminals 32 are connected to each other normally. Further, the front side of the sealing projections 17 are fit into the through-holes 51 of the sealing member 50 over the whole lengths.

In the male housing 10, the inner peripheral surfaces of the through-holes 51 of the sealing member 50 closely contact the peripheral surfaces of the sealing projections 17, with the sealing projections 17 breaking (i.e., folding) the lips 52. In the female housing 20, the contact surface 54 of the sealing member 50 is pressed against the front end surface 21 of the female housing 20, with the rib 35 of the front end surface 21 cutting into the contact surface 54. In this way, waterproofing in the chamber of the housing is accomplished.

Figure 9:
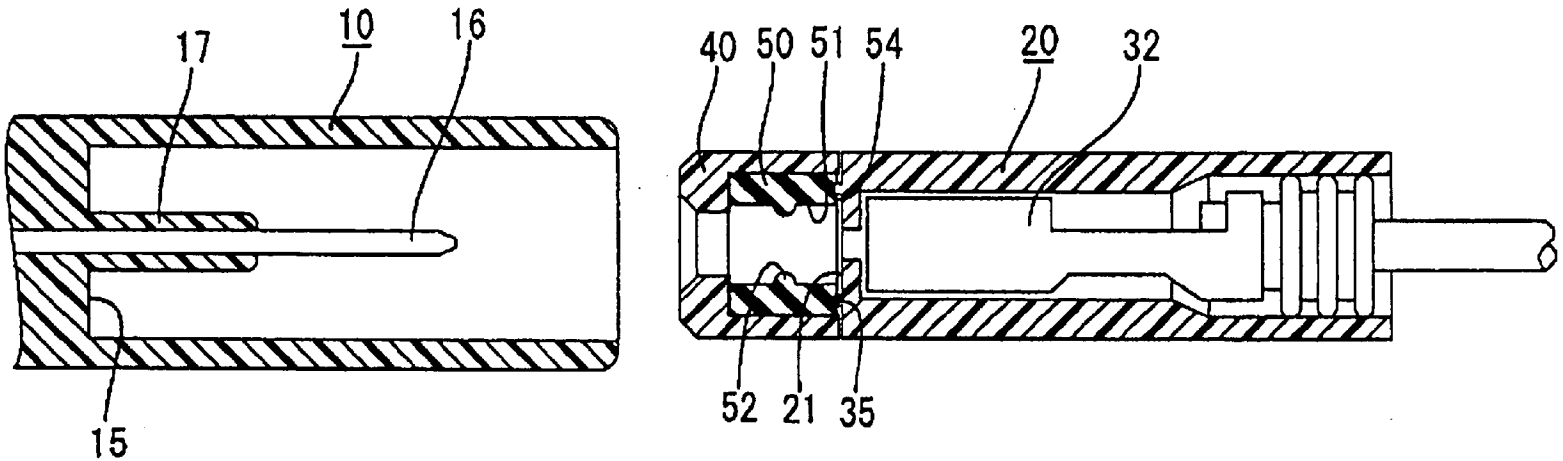
FIG. 9 is a side sectional view of a concept drawing showing a state before the male housing and the female housing have been fitted together to indicate the concept of the embodiment.
Figure 11:
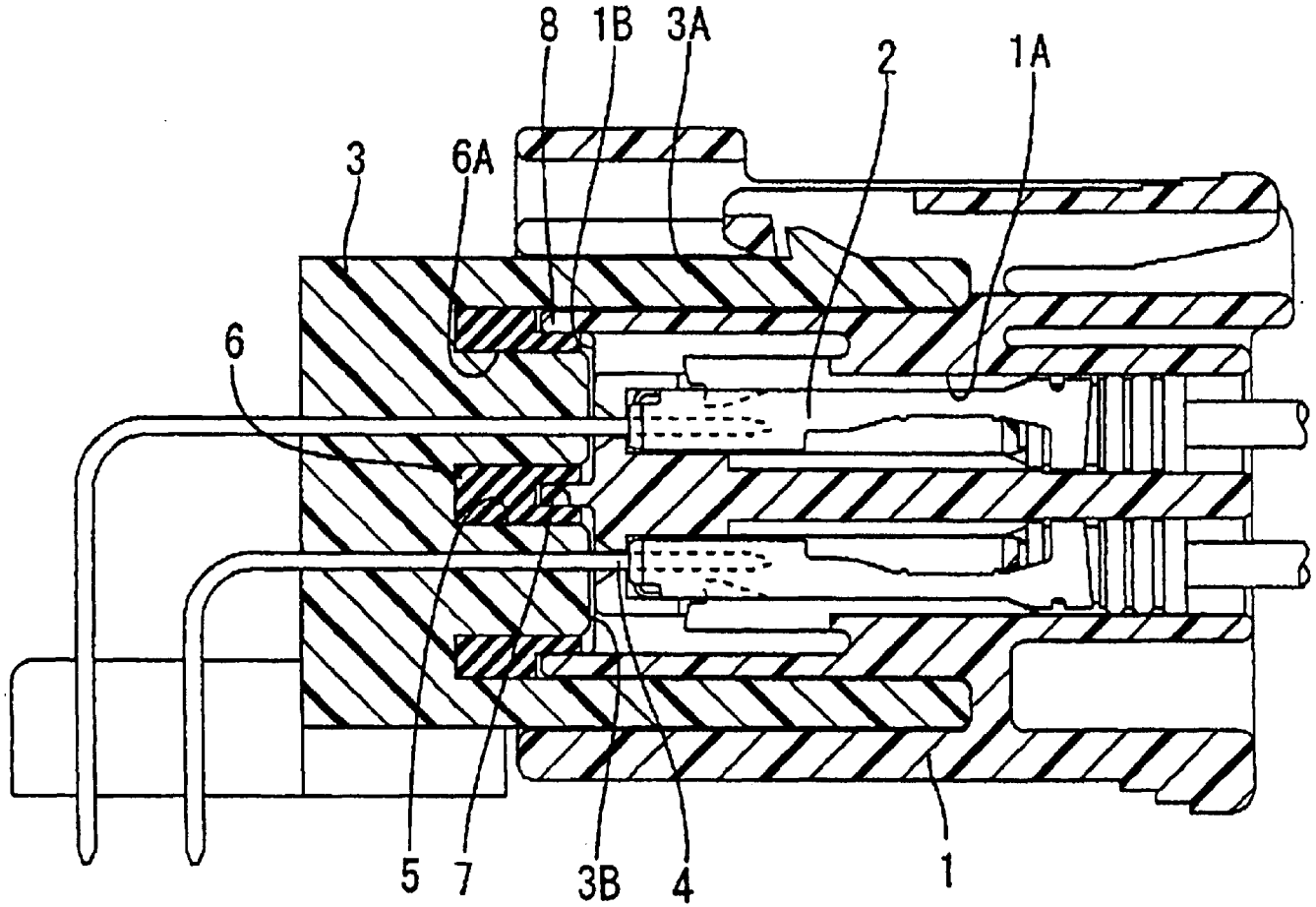
FIG. 11 PRIOR ART
FIG. 11 is a side sectional view showing a conventional connector of the prior art.
Figure 12:
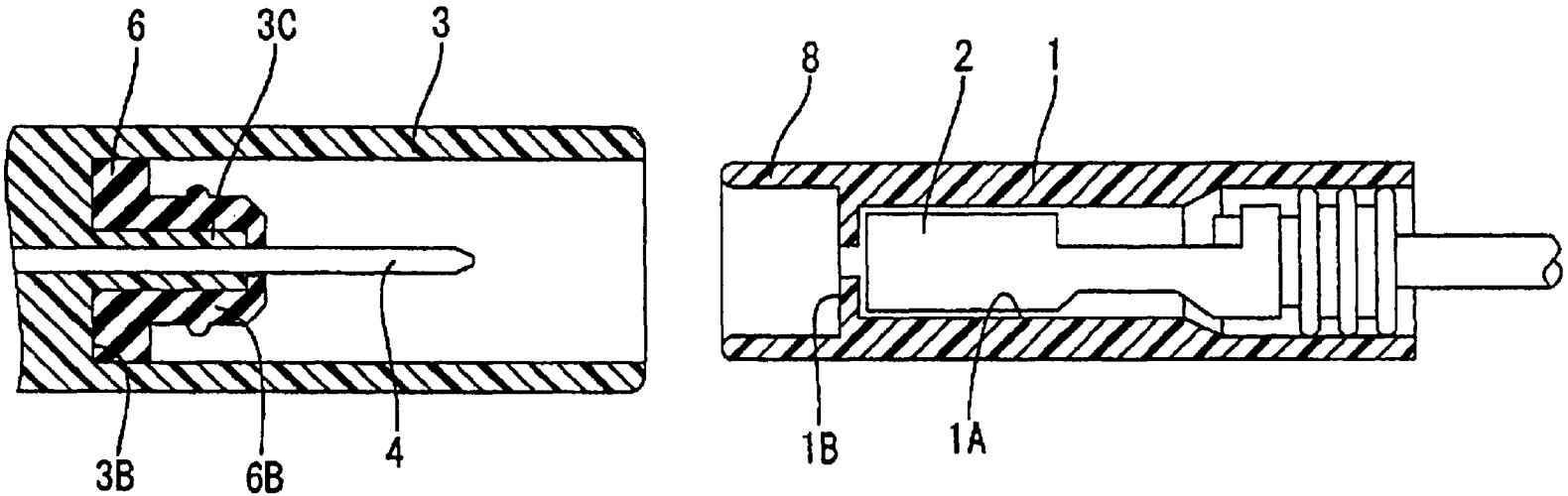
FIG. 12 PRIOR ART
FIG. 12 is a side sectional view of a concept drawing showing a state before the male housing and the female housing are fitted together to indicate the concept of the conventional connector of the prior art.
Figure 13A:
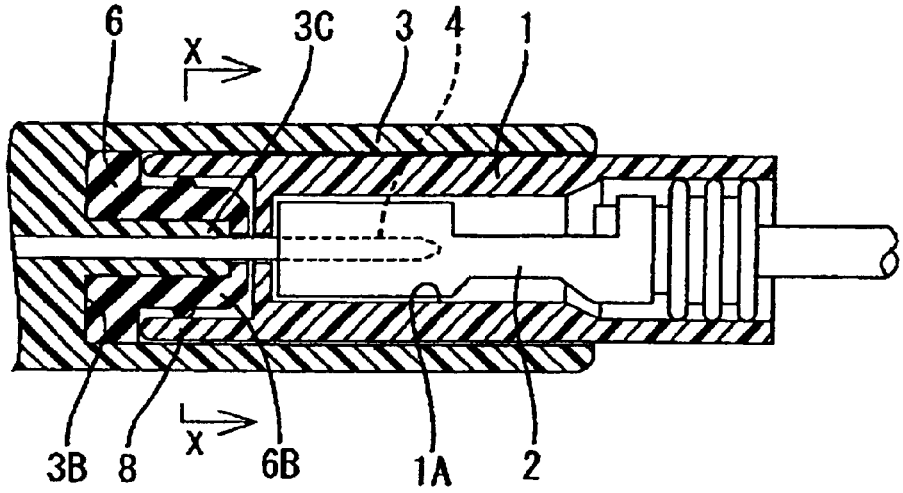
FIG. 13A PRIOR ART
FIG. 13A is a side sectional view of a concept drawing showing a state in which the male housing and the female housing of the prior art have been fitted together.

By using concept views, the effect of the embodiment is described below in comparison with the conventional connectors of the prior art. The concept of the above-described embodiment of the invention is shown in FIGS. 9 and 10. The concept of the conventional art is shown in FIGS. 12 and 13.

The construction of the embodiment and that of the conventional art are briefly described from a conceptual standpoint below. In a conventional construction, the annular portion 6B of the sealing member 6 is fit onto the projected portion 3C of the male terminal 4 on the front end surface 3B of male housing 3. As a result, the male housing 3 is sealed from water. On the front end surface 1B of the female housing 1, the rib 8 is erect around the front opening of the cavity 1A and fit onto the peripheral surface of the annular portion 6B of the sealing member 6. In this way, the female housing 1 is sealed from water.

On the other hand, in the embodiment of the present invention, the through-hole 51 of the sealing member 50 is fit onto the projected portion (sealing projection 17) of the male terminal at the front end surface 15 so that the male housing 10 is sealed to prohibit the ingresswater. The contact surface 54 of the sealing member 50 contacts (face contact) the front end surface 21 (rib 35) of the female housing 20. Accordingly, the female housing 20 is sealed to protect the see page of water into the housing.

Figure 13B:
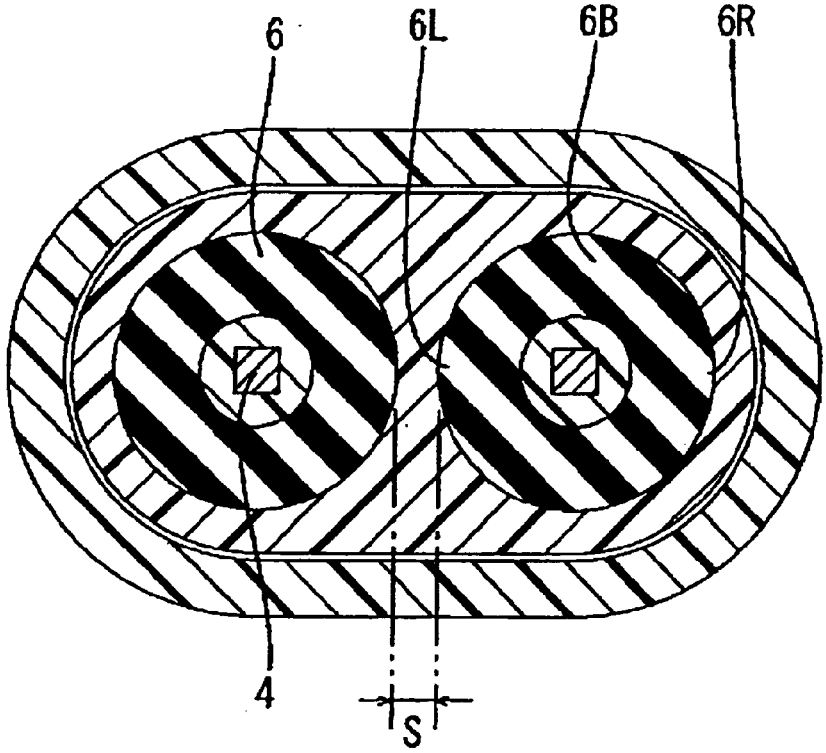
FIG. 13B PRIOR ART
FIG. 13B is an enlarged sectional view taken along a line 13B—13B of FIG. 13A.

In the conventional sealing construction of the female housing, the inner peripheral surface of the sealing member 6 (particularly, annular portion 6B) closely contacts the peripheral surface of the projected portion 3C of the male terminal 4. Thus, as shown in FIG. 13B, it is necessary to provide a sealing member 6 separately for each projected position of the male terminal 4, and to provide a space S between the adjacent male terminals 4 for the insertion of the rib 8 therebetween.

On the other hand, in the sealing construction of the female housing of the preferred embodiment of the invention, the sealing member 50 makes face contact with the front end surface of the female housing. Thus, as shown in FIG. 10B, it is unnecessary to form the rib insertion space. As a result, it is possible to make the interval between the adjacent terminal fittings 16 short, and to make the connector compact.

For example, let it be supposed that the intervals between the male terminals and between the female terminals are different from each other. In the conventional construction, the rib 8 fits on the peripheral surface of the annular portion 6B of the sealing member 6, and thus prevents radial movement of the sealing member 6. Therefore, in this example, referring to FIG. 13B, the annular portion 6B is compressed to a high degree along one side (shown with reference numeral 6R) thereof, whereas the annular portion 6B is compressed to a low degree along the other side (shown with reference numeral 6L) thereof. Therefore the female housing 1 and the male housing 3 are non-uniformly sealed from water.

On the other hand, in the preferred embodiment of the invention, the sealing member 50 contacts (i.e., with face contact) the front end surface 21 of the female housing 20. Thus, if there is a difference in the intervals between the male terminals and between the female terminals, the sealing member 50 is capable of absorbing the difference, with the sealing member 50 sliding on the front end surface 21 of the female housing 20. That is, in the male housing 10, the sealing member 50 accomplishes uniform sealing by the circumferential close contact between the through-hole 51 thereof and the sealing projection 17 of the male terminal 16. In the female housing 20, the sealing member 50 accomplishes uniform sealing by the close face contact between the contact surface thereof and the front end surface of the female housing 20.

Further, since the sealing member 50 is installed on the exposed front end surface of the female housing 20 in the preferred embodiment, it is easy to perform the sealing member-installing operation.

Furthermore the sealing member 50 is held securely by the holder 40 and formed integrally with the holder 40 by two-color molding. Therefore the number of component parts can be reduced and the mounting operation can be performed easily.

The present invention is not limited to the embodiment described with reference to the drawings, but the following embodiments are included in the technical scope of the present invention. The present invention can be embodied by making various modifications if they do not depart from the gist of the present invention.

(1) In the above-described embodiment, the sealing member is formed integrally with the holder. However, the sealing member may be formed separately from the holder.

(2) In the case where the sealing member is formed separately from the holder, the sealing member may be directly held on the front end surface of the female housing without using the holder.

(3) The male housing may have cavities into which male terminals are inserted.

What is claimed is:

1. A waterproof connector comprising:

a female housing having a plurality of cavities accommodating a plurality of female terminals;

a male housing, to connect to the female housing, having a plurality of male terminals and sealing projections each projecting from a front surface of the male housing, wherein one of the sealing projections extends about each of the male terminals, each said sealing projection having an outer peripheral wall extending generally parallel to a portion of the male terminal about which the sealing projection extends;

a sealing member positioned along a front surface of the female housing and having interior surfaces that define through-holes formed in positions that substantially correspond to the positions of the cavities of the female housing, wherein said interior surfaces of said sealing member include portions that each sealingly contacts the outer peripheral wall of a respective one of the sealing projections and forms a waterproof seal therewith when the male and female housings are fit together; and a holder that connects to the female housing to hold the sealing member to the front surface of the female housing.

2. A waterproof connector according to claim 1, wherein the sealing member is formed integrally with the holder by two-color molding.

3. A waterproof connector according to claim 1, in which the holder includes a locking piece that attaches to a complementary locking structure on the female housing to secure the sealing member to the front surface of the female housing.

4. A waterproof connector according to claim 3 wherein the locking piece is a rearwardly extending, cantilever member that biases outward to attach to the locking structure.

5. A waterproof connector according to claim 4 further including a plurality of said locking pieces and said locking structures, wherein one locking projection extends from each side of the holder and attaches to one of the locking structures.

6. A waterproof connector according to claim 5 wherein one of the locking pieces is longer than at least one other of the locking pieces.

7. A waterproof connector according to claim 1 in which one of the male and female housings includes a locking arm and the other of the male and female housings includes a locking member, wherein the locking arm is locked to the locking member when the male and female housings are fit together.

8. A waterproof connector according to claim 1 in which each of the through-holes of the sealing member includes a lip to contact the periphery of one of the sealing projections when the male and female housings are fit together.

9. A waterproof connector according to claim 1 wherein the front surface of the female housing includes a rib that engages the sealing member when the sealing member is positioned along the front surface of the female housing.

10. A waterproof connector according to claim 9 wherein the rib has a lattice configuration to separately surround each of the cavities.

11. A waterproof connector according to claim 9 wherein the rib cuts into the sealing member when the sealing member is positioned against the front surface of the female housing.

12. A waterproof connector comprising:

a female housing having a plurality of cavities accommodating a plurality of female terminals;

a male housing, to connect to the female housing, having a plurality of male terminals and sealing projections each projecting from a front surface of the male housing, wherein one of the sealing projections extends about each of the male terminals;

a sealing member positioned along a front surface of the female housing and having interior surfaces that define through-holes formed in positions that substantially correspond to the positions of the cavities of the female housing, wherein said interior surfaces of said sealing member include portions that each sealingly contacts one of the sealing projections about the periphery thereof and forms a waterproof seal therewith when the male and female housings are fit together; and a holder that connects to the female housing to hold the sealing member to the front surface of the female housing, wherein the holder includes a locking piece that attaches to a complementary locking structure on the female housing to secure the sealing member to the front surface of the female housing.

13. A waterproof connector according to claim 12 wherein the holder includes a front portion that is positioned forward of the sealing member and a rear portion that is positioned rearward and laterally outside of the sealing member, and wherein the rear portion includes the locking piece.

* * * * *